US011377901B2

(12) United States Patent
Isaksson

(10) Patent No.: US 11,377,901 B2
(45) Date of Patent: Jul. 5, 2022

(54) EXPLOSION RESISTANT WINDOW DEVICE AND A STRUCTURE PROVIDED WITH SUCH A WINDOW DEVICE

(71) Applicant: KEEP THE COMPANY AB, Ojebyn (SE)

(72) Inventor: Ulf Isaksson, Pitea (SE)

(73) Assignee: KEEP THE COMPANY AB

( * ) Notice: Subject to any disclaimer, the term of this patent is extended or adjusted under 35 U.S.C. 154(b) by 0 days.

(21) Appl. No.: 17/051,481

(22) PCT Filed: Mar. 26, 2019

(86) PCT No.: PCT/SE2019/050274
§ 371 (c)(1),
(2) Date: Oct. 29, 2020

(87) PCT Pub. No.: WO2019/212397
PCT Pub. Date: Nov. 7, 2019

(65) Prior Publication Data
US 2021/0230932 A1 Jul. 29, 2021

(30) Foreign Application Priority Data
May 3, 2018 (SE) ..... 1850530-5

(51) Int. Cl.
*E06B 5/12* (2006.01)
*E06B 1/60* (2006.01)
*E06B 1/16* (2006.01)

(52) U.S. Cl.
CPC ..... *E06B 5/12* (2013.01); *E06B 1/6084* (2013.01); *E06B 1/16* (2013.01); *E06B 1/6015* (2013.01)

(58) Field of Classification Search
CPC . E06B 5/12; E06B 5/10; E06B 1/6084; E06B 1/6015
See application file for complete search history.

(56) References Cited

U.S. PATENT DOCUMENTS

2003/0159376 A1 8/2003 Huynh
2003/0209332 A1 11/2003 Salzer
(Continued)

FOREIGN PATENT DOCUMENTS

DE 2740194 A1 * 3/1979 ..... E06B 5/12
DE 7836937 U1 * 4/1979 ..... E06B 1/6084
(Continued)

OTHER PUBLICATIONS

Patent Cooperation Treaty (PCT), International Search Report and Written Opinion for Application PCT/SE2019/050274 filed on Mar. 26, 2019, dated Jun. 25, 2019, International Searching Authority, SE.

(Continued)

*Primary Examiner* — Michael Safavi
(74) *Attorney, Agent, or Firm* — McDonald Hopkins LLC

(57) ABSTRACT

A window device comprising: a window, window frame, a window holder element, to which the window is attached along a periphery of the window, a window-motion dampening element, and a coupling device via which the window holder element is in engagement with the window frame. The coupling device comprises a projection and a guide recess and is arranged at the inner periphery of the window frame and, from a normal operation position of window, it allows motion of the window holder element in a first direction in which the window holder element is arranged to compress and deform the dampening element, but prevents the window holder element from moving in an opposite second direction.

10 Claims, 1 Drawing Sheet

(56) References Cited

U.S. PATENT DOCUMENTS

| | | | | |
|---|---|---|---|---|
| 2008/0178540 | A1* | 7/2008 | Salzer | E06B 5/106 52/202 |
| 2009/0007518 | A1 | 1/2009 | Salzer | |
| 2021/0222450 | A1* | 7/2021 | Zobec | E06B 5/10 |

FOREIGN PATENT DOCUMENTS

| | | | | |
|---|---|---|---|---|
| DE | 8911833 | | 2/1981 | |
| DE | 8221467 | | 9/1983 | |
| DE | 202007004060 | | 5/2007 | |
| DE | 202007007113 | | 8/2007 | |
| DE | 202007007114 | | 8/2007 | |
| EP | 1992753 | | 11/2008 | |
| EP | 1992753 | A2 * | 11/2008 | E04B 2/96 |
| EP | 2131007 | A1 * | 12/2009 | E06B 9/02 |
| GB | 2201183 | | 8/1988 | |
| GB | 2284000 | | 5/1995 | |
| IT | VI20120322 | | 5/2014 | |
| WO | 2005039950 | | 5/2005 | |
| WO | 20140183610 | | 11/2014 | |
| WO | WO-2015171775 | A1 * | 11/2015 | E04H 9/14 |

OTHER PUBLICATIONS

Extended European Search Report for Application 19796467.9, PCT/SE2019/050274, dated Dec. 13, 2021, 7 pgs., European Patent Office, Germany.

* cited by examiner

EXPLOSION RESISTANT WINDOW DEVICE AND A STRUCTURE PROVIDED WITH SUCH A WINDOW DEVICE

CROSS-REFERENCE TO RELATED APPLICATION

This application is a 35 U.S.C. § 371 national stage application of PCT Application No. PCT/SE2019/050274 filed on Mar. 26, 2019, entitled "EXPLOSION RESISTANT WINDOW DEVICE AND A STRUCTURE PROVIDED WITH SUCH A WINDOW DEVICE," which claims priority to Swedish Patent Application No. 1850530-5 filed on May 3, 2018, each of which are incorporated herein in their entirety by reference.

TECHNICAL FIELD

The present invention relates to a window device comprising: a window, a window frame, a window holder element, to which the window is attached along a periphery of the window, a window-motion dampening element, and a coupling device via which the window holder element is in engagement with the window frame, wherein the dampening element is arranged between window holder element and the window frame and is arranged to be compressed and deformed by the window holder element upon motion of the window and the window holder element in a first direction, which is perpendicular to the main extension plane of the window.

The window need not necessarily be planar, but may concave, convex or present other shapes.

BACKGROUND

Windows in different structures such as buildings and vehicles may comprise a window of laminated glass attached to a window holder, which in its turn is attached to a window frame. The window frame may be a separate frame which is fixedly attached to a wall of a structure, or may be an integrated part of the wall itself. The window holder may be permanently fixed in the window frame by means of different kind of coupling arrangements.

For different reasons, the window may be subjected to strong forces, for example caused by explosions or direct violence, in particular from outside. Therefore, it has been suggested by prior art to arrange coupling arrangements that permit a motion of the window relative to the window frame under counteraction by a dampening element. Thereby, the effects of such forces on the window itself, on the window holder and on the window frame may be to some extent suppressed by the action of the dampening element. The dampening element may be a spring element, or any kind of suitable motion damping element.

It is an object of the present invention to present an window device that enables un uncomplicated mounting of a window and window holder into a window frame, and that enables a damped motion of the window and the window holder relative to the window frame in case of a force being applied to the window in one direction. At the same time the window device should be arranged such that it prevents a motion of the window in an opposite direction as the window is in a normal use position.

SUMMARY OF THE INVENTION

The object of the invention is achieved by means of the initially defined window device, characterised in that the coupling device comprises a guide recess arranged in a first of the inner periphery of the window frame and the window holder element, said guide recess being elongated and extending in its longitudinal direction in said first direction, and a projection attached to a second of said inner periphery of the window frame and the window holder element, wherein the projection extends into the guide recess and is able of sliding in the guide recess in said first direction or a second direction opposite to the first direction, and that, in a normal operation position of the window in which the dampening element is not compressed and positioned between the window holder element and the window frame, the projection of the coupling device is located at a first end of the guide recess, such that motion of the window holder in the second direction is prevented but motion of the window holder in the first direction is allowed by the coupling device.

It should be noted the "sliding" of the projection along the recess is a relative motion. If the recess is provided in the window holder element, the relative motion is caused by the motion of the window holder element, and thus by the recess rather than by the projection itself.

A "normal operation position" may be referred to as a mounting position in which the window and window holder is fitted into the window frame and in which the dampening element is not compressed by the action of any unintended force onto the window.

The dampening element could be any kind of suitable element for that purpose designed to be compressed and thereby deformed by the window holder element upon motion of the window holder in said first direction. The dampening element may for example comprise a spring or a resilient piece of material. According to one embodiment, the dampening element extends all around the circumference of the window frame. It may however be subdivided in sub-pieces. In a wide sense of the invention there are different possibilities of designing the window holder element, the window frame and the dampening element, and thus also how to position the dampening element. For example, the dampening element may be located between a front side of the window frame and a part of the window holder element, such that the dampening element is compressed between the window frame and said part of the window holder element when the latter is displaced in said first direction. As an alternative, or supplement, the dampening element may for example be located in the recess of a coupling device as defined hereinabove or hereinafter, and thereby become squeezed between the material that defines the guide recess and the projection (which is then defined as forming part of the component to which it is attached) upon displacement of the window holder element in said first direction in relation to the frame.

The term "attached to", which is used for describing how the projection is arranged relative the window holder element or the window frame, should be interpreted widely. As will be seen, it may include a pin being inserted in a hole in the component in question, and thus not necessarily being fixedly attached to the component, but still being able of delivering its' guiding and motion locking function by engaging the guide recess. The projection is thus in locking engagement with the one of the window holder element and the window frame that does not comprise the guide recess in such a way that it is prevented from moving in said first or second direction in relation to that part. The projection may be regarded as part of the component to which it is attached.

According to one embodiment, the window holder element has a first leg and a second leg that render the window holder element an L-shaped cross-section, the first leg of the L-shaped window holder element extends along and opposite to an inner periphery of the window frame, wherein one of said guide recess and projection is arranged in or attached to said first leg, the second leg of the L-shaped window holder element extends along and opposite to a front side of the window frame, and the dampening element is arranged between the second leg of the L-shaped window holder element and the front side of the window frame and is arranged to be compressed and deformed by the second leg of the window holder element upon motion of the window and the window holder element in said first direction.

According to one embodiment, the dampening device has a maximum deformation length A in said first direction and that the projection has a maximum motion distance B in the guide recess from said first end of the guide recess to an opposite second end thereof, and that A<B. Thereby, the coupling device, in particular the projection, will not run the risk of adopting the whole force that may be applied to the window, for example as a result of an explosion or direct violence, since the projection will not move all the way to the opposite end of the recess. When the compression of the dampening device has come to an end, forces in the first direction are thus adopted by the second leg of the window holder element rather than by the projection of the coupling device.

According to one embodiment, the window is attached by means of an adhesive to a side of the second leg of the window holder element which is opposite to a side of said second leg that is turned towards the damping element. Thereby, forces applied to the window in said first direction are transferred directly from the window to the second leg of the window holder and further to the dampening element.

According to one embodiment, the guide recess of the coupling device is an elongated slot arranged in the first leg of the window holder element.

According to one embodiment, the window device is characterised in that the window frame comprises a hole for receipt of the projection and that the projection of the coupling device is a bolt or pin which extends through the guide recess and into said hole. Thereby, uncomplicated mounting of the window holder element to the window frame is enabled. The window holder element, normally with the window already attached thereto, is inserted into the window frame and is connected to the window frame and prevented from falling out of the latter in the second direction as the pins or bolts are inserted into the slots from the inner periphery of the window frame holder and further into the receiving holes in the window frame.

According to one embodiment, the window device comprises a plurality of coupling devices as defined hereinabove or hereinafter provided along a circumference of the window frame. Thereby, the securing and prevention of the window holder element from falling out of the window frame in the second direction may be distributed evenly along the circumference of the window holder element and the window frame. Upon motion of the window holder element in the first direction, under compression of the dampening element and caused by forces on the window in said first direction, the plurality of coupling devices, acting as guides, will promote a linear motion of the window element holder, also in those cases when there are lateral forces acting on the window in addition to the force in the first direction. A linear motion is preferred since it will reduce the risk of having severe damages on the window frame and/or a wall or the like to which the window frame may be attached.

According to one embodiment, the window frame, as seen in said first direction, is a polygon, and there is provided at least one respective coupling device in the region of each corner of the polygon. Provision of coupling elements in the regions of corners of a polygon provides for improved guiding performance. The term "in the region" may be referred to as closer to the corner in question than to a mid-point between the corner in question and a neighbouring corner.

According to one embodiment, the window frame, as seen in said first direction, is a polygon, and on opposite sides of each corner of the polygon there is provided a coupling device that is closer to said corner than to a neighbouring corner.

The object of the invention is also achieved by means of a structure comprising a wall, said wall being provided with an opening therein, and the structure being characterised in that it comprises a window device as defined hereinabove or hereinafter provided in said opening, and that the window frame is fixedly attached to said wall. The term "fixedly attached" includes that the window frame is an integrated part of the wall or a separate part which is fixedly connected to the wall. In one embodiment, the window frame actually is a separate part which is fixedly connected to the wall.

The term "structure" may include buildings, vehicles or any structure that are provided with a window device as defined in this disclosure. According to one embodiment, the front side of the window frame is directed towards the exterior of such a structure, whereby the first direction is a direction from an outside towards an inside of said structure.

Further possible features and advantages of the window device and structure of the present invention will be presented in the following detailed description of embodiments.

BRIEF DESCRIPTION OF THE DRAWINGS

Exemplifying embodiments of the present invention will be presented in the following detailed description with reference to the annexed drawing, on which.

DETAILED DESCRIPTION

Figure 1:
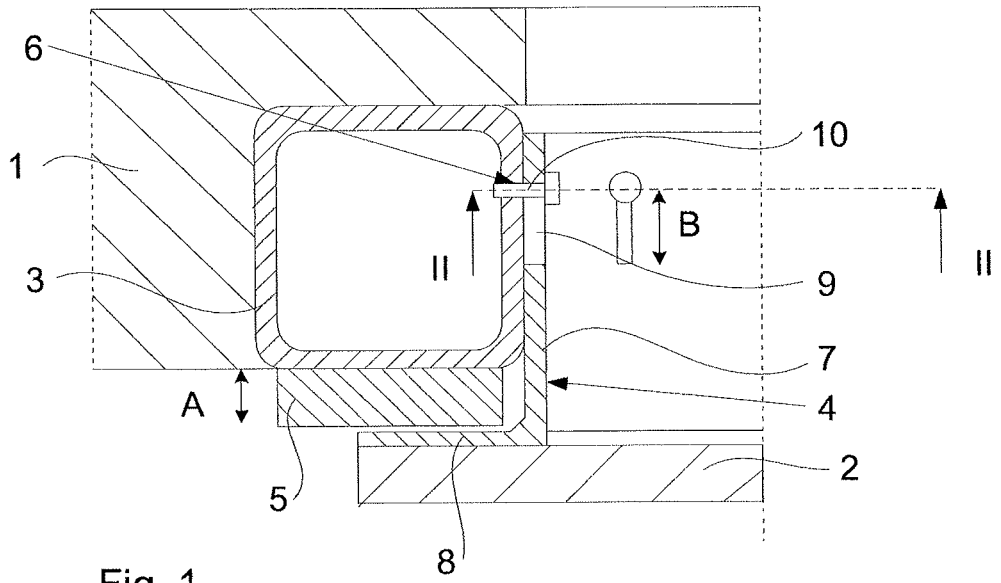
FIG. 1 is a cross section of a part of a structure provided with a window device according to the invention as seen from above.

FIG. 1 shows a part of a structure comprising a wall 1 which comprises an opening into which a window device according to the present invention is fitted and mounted.

The window device comprises a window 2, a window frame 3, a window holder element 4, to which the window 2 is attached along a periphery of the window 2. The window device further comprises a window-motion dampening element 5, and a coupling device 6 via which the window holder element 4 is in engagement with the window frame 3. The window holder element 4 has a first leg 7 and a second leg 8 that render the window holder element 4 an L-shaped cross-section. The first leg 7 of the L-shaped window holder element 4 extends along and opposite to an inner periphery of the window frame 3. The second leg 8 of the L-shaped window holder element 4 extends along and opposite to a front side of the window frame 3. The dampening element 5 is arranged between the second leg 8 of the L-shaped window holder 4 and the front side of the window frame 3 and is arranged to be compressed and deformed by the second leg 8 of the window holder element 4 upon motion of the window 2 and the window holder element 4 in a first direction, which is perpendicular to the main extension plane of the window 2.

The window 2 comprises a sheet of laminated glass. In the embodiment described here, the window is a planar sheet. However, it should be understood that also non-planar shapes, such as a convex window shape, are conceived.

The window frame 2 is formed by a metal profile attached to the inner periphery of an opening in the wall 1. In the embodiment shown, the metal profile is a tube having a square cross-section, as can be seen in FIG. 1. Other frame designs are also conceivable.

The window holder element 3 is formed by lathes that have an L-shaped cross-section and that extend around the outer periphery of the window 2. The lathes may be connected to each other, for example by welds, in the corner regions of the window. The window holder element 3 may, off course, also be constituted by a continuous lathe extending around the outer periphery of the window 2. The window 2 is attached by means of an adhesive to a side of the second leg 8 of the window holder element 4 which is opposite to a side of said second leg 8 that is turned towards the damping element 5.

The coupling device 6 comprises a guide recess 9 arranged in the first leg 7 of the window holder element 4. The guide recess 9 is elongated and extends in its longitudinal direction in said first direction. The coupling device 6 further comprises a projection 10, here formed by a bolt 10, attached to the inner periphery of the window frame 3, wherein the projection 10 extends into the guide recess 9 and is able of sliding in the guide recess 9 in said first direction or a second direction opposite to the first direction as the window holder element 4 is moved in the first or second direction in relation to the window frame 3. The guide recess 9 forms a slot in the first leg 7 such that the projection formed by the bolt 10 can be screwed into a receiving hole in the inner periphery of the window frame 3 by being inserted through the recess 9 from the inner periphery of the first leg 7, i.e. the side opposite the side of the first leg that is directed towards the adjacent inner periphery of the window frame 3. In other words, the bolt 10 is attached to the window frame 3 by being in engagement with the window frame 3 through a threading in a receiving hole in the window frame.

FIG. 1 shows a normal operation position of the window 2 in which the dampening element 5 is not compressed and is positioned between the second leg 8 of the window holder element 4 and the window frame 3. In this position of the window 2, the projection 10 of the coupling device 6 is located at a first end of the guide recess 9, such that motion of the window holder element 4 in the second direction is prevented but motion of the window holder element 4 in the first direction is allowed by the coupling device 6. There is a small gap between the second leg 8 of the window holder element 4 and the dampening element 5 as seen in said first direction, which is for tolerance reasons, to ensure that the bolt 10 is enabled to be screwed into the receiving hole provided in the window frame 3 without being hindered due to, for example, the dampening element being slightly thicker than expected somewhere along the circumference of the window frame. The gap may preferably be filled with a suitable sealing mass or element (not shown), and should be small in order to minimize possible motion of the window in the first direction without deformation of the dampening element 5.

Figure 2:
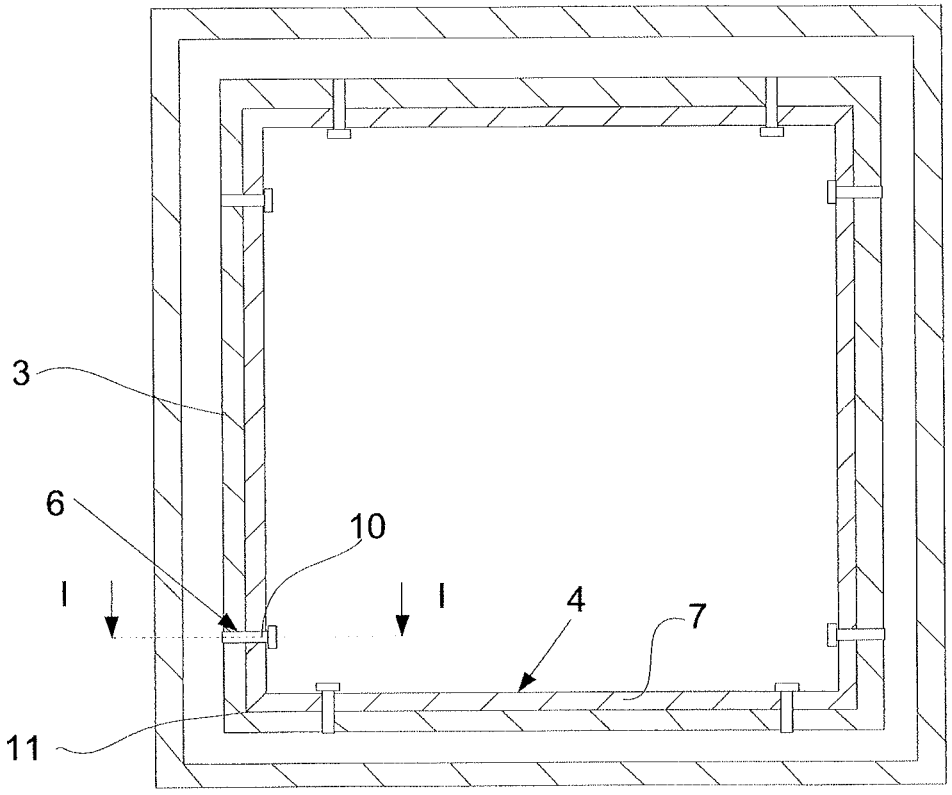
FIG. 2 is a cross section of parts of a window device as seen in a direction indicated with II-II in FIG. 1.

FIG. 2 shows a cross-section of the window frame 3, the window holder element 4 as seen in the first direction and according to II-II in FIG. 1. FIG. 1, on its hand, shows a cross-section according to I-I in FIG. 2. As can be seen in FIG. 2, the window frame 3, as seen in said first direction, is a polygon, in this case a rectangle. On opposite sides of each corner 11 of the polygon there is provided a coupling device 6 that is closer to said corner than to a neighbouring corner.

The invention is not, however, restricted to only polygonal windows and window frames. It should be understood that also other shapes, such as oval or circular shapes, may be conceived.

The invention claimed is:

1. A window device comprising:

a window, window frame, a window holder element, to which the window is attached along a periphery of the window, a window-motion dampening element, and a coupling device via which the window holder element is in engagement with the window frame, wherein the dampening element is arranged between window holder element and the window frame and is arranged to be compressed and deformed by the window holder element upon motion of the window and the window holder element in a first direction, which is perpendicular to the main extension plane of the window, wherein the coupling device comprises a guide recess arranged in a first of an inner periphery of the window frame and the window holder element, said guide recess being elongated and extending in its longitudinal direction in said first direction, and a projection attached to a second of said inner periphery of the window frame and the window holder element, wherein the projection extends into the guide recess and is able of sliding in the guide recess in said first direction or a second direction opposite to the first direction, and that, in a normal operation position of the window in which the dampening element is not compressed and is positioned between the window holder element and the window frame, the projection of the coupling device is located at a first end of the guide recess, such that motion of the window holder element in the second direction is prevented but motion of the window holder element in the first direction is allowed by the coupling device.

2. A window device according to claim 1, wherein the window holder element has a first leg and a second leg that render the window holder element an L-shaped cross-section, the first leg of the L-shaped window holder element extends along and opposite to an inner periphery of the window frame, wherein one of said guide recess and said projection is arranged in or attached to said first leg, the second leg of the L-shaped window holder element extends along and opposite to a front side of the window frame, and wherein the dampening element is arranged between the second leg of the L-shaped window holder element and the front side of the window frame and is arranged to be compressed and deformed by the second leg of the window holder element upon motion of the window and the window holder element in said first direction.

3. A window device according to claim 1 wherein the dampening element has a maximum deformation length A in said first direction and that the projection has a maximum motion distance B in the guide recess from said first end of the guide recess to an opposite second end thereof, and that A<B.

4. A window device according to claim 2, wherein the window is attached by means of an adhesive to a side of the second leg of the window holder element which is opposite to a side of said second leg that is turned towards the damping element.

5. A window device according to claim 2, wherein the guide recess of the coupling device is an elongated slot arranged in the first leg of the window holder element.

6. A window device according to claim 5, wherein the window frame comprises a hole for receipt of the projection and that the projection of the coupling device is a bolt or pin which extends through the guide recess and into said hole.

7. A window device according to claim 1, further comprising a plurality of coupling devices provided along a circumference of the window frame.

8. A window device according to claim 7, wherein the window frame, as seen in said first direction, is a polygon, and that there is provided at least one respective coupling device in the region of each corner of the polygon.

9. A window device according to claim 7, wherein the window frame, as seen in said first direction, is a polygon, and that on opposite sides of each corner of the polygon there is provided a coupling device that is closer to said corner than to a neighbouring corner.

10. A structure comprising a wall, said wall being provided with an opening therein, and wherein the structure comprises a window device according to claim 1 provided in said opening, and that the window frame is fixedly attached to said wall.

* * * * *